US012245661B2

(12) United States Patent
Skale

(10) Patent No.: US 12,245,661 B2
(45) Date of Patent: Mar. 11, 2025

(54) CONVERTIBLE SHOE DEVICE

(71) Applicant: Abigail Washington Skale, Poway, CA (US)

(72) Inventor: Abigail Washington Skale, Poway, CA (US)

( * ) Notice: Subject to any disclaimer, the term of this patent is extended or adjusted under 35 U.S.C. 154(b) by 185 days.

(21) Appl. No.: 17/963,163

(22) Filed: Oct. 10, 2022

(65) Prior Publication Data

US 2024/0114990 A1 Apr. 11, 2024

(51) Int. Cl.

| | |
|---|---|
| ***A43B 3/24*** | (2006.01) |
| ***A43B 3/12*** | (2006.01) |
| ***A43C 11/14*** | (2006.01) |

(52) U.S. Cl.

CPC ..... *A43B 3/244* (2013.01); *A43B 3/122* (2013.01); *A43B 3/126* (2013.01); *A43C 11/1493* (2013.01)

(58) Field of Classification Search

CPC ..... A43B 3/244; A43B 3/122; A43B 3/126; A43B 3/103; A43B 3/24; A43B 3/10; A43B 1/0054; A43C 11/1493

See application file for complete search history.

(56) References Cited

U.S. PATENT DOCUMENTS

| | | | | |
|---|---|---|---|---|
| 4,172,330 | A * | 10/1979 | Kao | A43B 3/103 36/11.5 |
| 6,418,643 | B1 * | 7/2002 | Yang | A43B 23/24 36/11.5 |
| 7,681,330 | B2 * | 3/2010 | Lewis | A43B 3/103 36/15 |
| 7,823,299 | B1 * | 11/2010 | Brigham | A43B 3/24 36/11.5 |
| 10,104,931 | B1 * | 10/2018 | Krastev | A43B 3/103 |
| 10,206,450 | B1 * | 2/2019 | Krastev | A43B 3/0078 |
| 10,588,376 | B1 * | 3/2020 | Li | A43B 13/12 |
| 2005/0132616 | A1 * | 6/2005 | Yu | A43B 17/18 36/15 |
| 2008/0060227 | A1 * | 3/2008 | Enderson | A43B 3/103 36/23 |
| 2010/0170113 | A1 * | 7/2010 | Garza | A43B 3/103 36/136 |
| 2012/0079738 | A1 * | 4/2012 | Alberi | A43B 3/122 36/11.5 |
| 2013/0091732 | A1 * | 4/2013 | Mendoza | A43B 3/0078 36/100 |

(Continued)

*Primary Examiner* — Jameson D Collier

(74) *Attorney, Agent, or Firm* — Andrew Skale; Mark Hammond; Mintz, Levin, Cohn, Ferris, Glovsky and Popeo, P.C.

(57) ABSTRACT

Methods for converting a shoe from the flip-flop configuration to a sandal configuration are described herein. The method also includes connecting at least three foot fastener connectors to a first sole connector, a second sole connector, and a third sole connector of the at least three sole connectors, wherein said connecting causes the at least three foot fastener connectors to form a toe thong in a flip-flop configuration. The method further includes sliding the first sole connector along a first slide path from a first flip-flop position to a first sandal position, sliding the second sole connector along a second slide path from a second flip-flop position to a second sandal position, and sliding the third sole connector along a third slide path from a third flip-flop position to a third sandal position.

12 Claims, 7 Drawing Sheets

(56) References Cited

U.S. PATENT DOCUMENTS

| | | | | |
|---|---|---|---|---|
| 2014/0000127 | A1* | 1/2014 | Tang | A43B 3/242<br>36/25 R |
| 2014/0165426 | A1* | 6/2014 | Chapin | A43B 3/126<br>36/100 |
| 2015/0128447 | A1* | 5/2015 | Verona | A43B 3/244<br>36/11.5 |
| 2015/0237950 | A1* | 8/2015 | Caldwell | A43B 3/126<br>36/100 |
| 2016/0242492 | A1* | 8/2016 | Huang | A43B 3/122 |
| 2016/0302511 | A1* | 10/2016 | Blowers | A43B 3/103 |
| 2017/0119086 | A1* | 5/2017 | Hillyer | A43B 3/244 |
| 2017/0318895 | A1* | 11/2017 | Thomasson | A43B 3/122 |
| 2017/0360142 | A1* | 12/2017 | Griffin | A43B 3/128 |
| 2019/0261726 | A1* | 8/2019 | L'Hermet | A43B 3/244 |
| 2019/0261727 | A1* | 8/2019 | L'Hermet | B32B 3/266 |

* cited by examiner

CONVERTIBLE SHOE DEVICE

FIELD

This disclosure relates generally to a pair of shoes that convert from a pair of flip-flip shoes with a toe thong to a pair of sandal shoes without a toe thong, and vice versa.

BACKGROUND

Many users desire to wear flip-flop shoes having a toe thong as it provides for the toe to more easily secure the foot to the shoe. However, many of these same users sometimes desire a sandal shoe without a toe thong, as it provides for more comfort in that there is nothing between the user's toes, or it can allow a user to wear socks. It is desirable to have a shoe that can convert between a flip-flip with a toe thong to a sandal without a toe-thong.

SUMMARY

In view of the foregoing, there is a need for methods and apparatus for converting a flip-flip shoe with a toe thong to a sandal shoe without a toe thong, and vice versa.

Provided herein is a system including a pair of shoes. The pair of shoes includes a left sole and a right sole. At least 6 sole connectors on the left sole and at least 6 sole connectors on the right sole. The pair of shoes also includes a left foot fastener and a right foot fastener. At least 3 foot fasteners connectors are positioned on said left foot fastener and at least 6 sole connectors are positioned on said right sole. Said left foot fastener is configured to connect to said left sole in a sandal mode and said right foot fastener is configured to connect to said right sole in a sandal mode. Said left foot fastener is further configured to connect to said left sole in a flip-flop mode forming a toe thong, and said right foot fastener is further configured to connect to said right sole in said flip-flop mode forming a toe thong.

As used herein, a sandal is a shoe that does not have a toe thong. As used herein, a flip-flop is a shoe that does have a toe thong. As used herein, toe thong is formed from a foot fastener that is positioned between two toes that is used to help keep the shoe on the user's foot. The toe thong is usually between the first and second toes, however, it may be between any two adjacent toes.

In one embodiment, the at least 6 sole connectors on the left sole, the at least 6 sole connectors on the right sole, the at least 3 foot fasteners connectors on the left foot fastener, and the at least 3 foot fasteners connectors on the right foot fastener can include Velcro® (i.e. a type of hook-and-loop fastener). The at least 3 foot fasteners connectors on the left foot fastener and the at least 3 foot fasteners connectors on the right foot fastener can be Velcro® hooks, and the at least 6 sole connectors on the left sole and the at least 6 sole connectors on the right sole can be Velcro® loops.

In one embodiment, the at least 6 sole connectors on the left sole, the at least 6 sole connectors on the right sole, the at least 3 foot fasteners connectors on the left foot fastener, and the at least 3 foot fasteners connectors on the right foot fastener can include magnets.

In one embodiment, the at least 6 sole connectors on the left sole can be 7 sole connectors, the at least 6 sole connectors on the right sole can be 7 sole connectors, the at least 3 foot fasteners connectors on the left foot fastener can be 4 foot fasteners connectors, and the at least 3 foot fasteners connectors on the right foot fastener can be 4 foot fasteners connectors.

In one embodiment, the pair of shoes can also include a left cover and a right cover. The left cover covers the left sole and the right cover covers the right sole. The left cover includes at least one slit that covers at least one sole connector of the at least 6 sole connectors on the left sole, and the right cover includes at least one slit that covers at least one sole connector of the at least 6 sole connectors on the right sole. The at least one slit can be in the shape of an "X." The left cover can include one slit that covers one sole connector of each of the at least 6 sole connectors on the left sole, and the right cover can include one slit that covers one sole connector of each of the at least 6 sole connectors on the right sole.

In one embodiment, the left foot fastener and/or the right foot fastener can include a shaping area configured to shape the left foot fastener and/or the right foot fastener into the toe thong in the flip-flop mode.

In one embodiment, the pair of shoes can also include at least one slide connector. The at least one slide connector is configured to change the left foot fastener and/or the right foot fastener from the flip-flop mode to the sandal mode.

In a related aspect, provided is method for using a shoe. The shoe includes a sole with at least 6 sole connectors are on the sole. The method includes connecting at least 3 foot fastener connectors on a foot fastener to at least 3 sole connectors. The connecting causes the foot fastener to form a toe thong such that the shoe is in a flip-flop mode. The method includes connecting the at least 3 foot fastener connectors on a foot fastener to another at least 3 sole connectors. The connecting causes the foot fastener to place the shoe in a sandal mode. The at least 3 foot fastener connectors can be magnets or can be Velcro®. The shoe can include a cover and connecting the at least 3 foot fastener connectors on the foot fastener can include connecting the at least 3 foot fastener connectors on the foot fastener through a slit in the cover that covers the at least 3 sole connectors and/or another at least 3 sole connectors. The method for using a shoe can further include adjusting the length of the foot fastener.

Provided herein is an apparatus including a shoe. The shoe includes a sole with 6 sole connectors positioned on the sole. The shoe also includes a cover positioned over the sole and the 6 sole connectors. The cover including 6 slits with each slit of the 6 slits disposed over each sole connector of the 6 sole connectors. The shoe also includes a foot fastener. The foot fastener includes a shaping area configured to shape the foot fastener into a toe thong when the shoe is in a flip-flop mode. Three foot fasteners connectors are positioned on the foot fastener. The foot fastener is configured to connect to the sole in a sandal mode, and the foot fastener is further configured to connect to the sole in the flip-flop mode forming the toe thong.

In one embodiment, the 6 sole connectors can be Velcro® loops and the 3 foot fasteners connectors can be Velcro® hooks.

In one embodiment, the foot fastener can be made from an elastic material, and the positioning of the 6 sole connectors on the sole is such that the foot fastener stretches to accommodate a difference in lengths between when the shoe is in the sandal mode and when the shoe is in the flip-flop mode.

In one embodiment, the foot fastener can be made from an inelastic material, and the positioning of the 6 sole connectors on the sole is such that the foot fastener does not stretch between when the shoe is in the sandal mode and when the shoe is in the flip-flop mode.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE FIGURES

The present invention is illustrated by way of example, and not by way of limitation, in the figures of the accompanying drawings in which.

DETAILED DESCRIPTION

The following description and the drawings illustrate specific embodiments sufficient to enable those skilled in the art to practice the system and method described. Other embodiments may incorporate structural, logical, process and other changes. Examples merely typify possible variations. Individual components and functions are generally optional unless explicitly required, and the sequence of operations may vary. Portions and features of some embodiments may be included in or substituted for those of others.

As shown in the attached figures, embodiments comprising a flip-flip shoe with a toe thong convert to a sandal shoe without a toe thong, and vice versa, are disclosed. An embodiment according to the present disclosure connects a foot fastener to a sole to allow a shoe to convert to flip-flop mode to allow the shoe to be used as a flip-flip. An embodiment according to the present disclosure connects a foot fastener to a sole to allow a shoe to convert to a sandal mode to allow shoe to be used as a sandal. The foot fastener can be connected to the sole using a variety of connection devices, including Velcro, magnets, hook-and-loop fasteners, snaps, buckles, slides, zippers, buttons, clasps, eyelets, frog closures, pins, laces, loop fasteners, grommets, hook and eyes, and the like.

Figure 1:
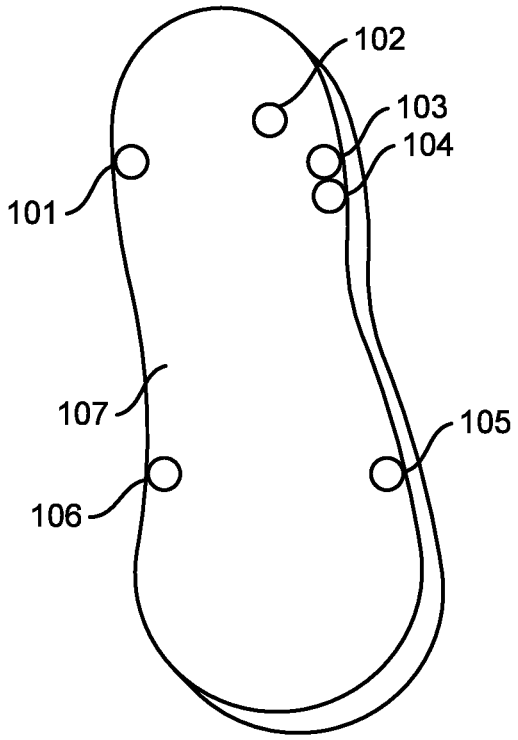
FIG. 1 is top view of a left sole disclosing an embodiment according to the present disclosure.

FIG. 1 shows a left shoe of an embodiment disclosing sole 107. Sole 107 contains a plurality of sole connectors, such as circular Velcro® connectors. For example, sole 107 can have a plurality of Velcro® loop connectors including first sole connector 101, second sole connector 102, third sole connector 103, fourth sole connector 104, fifth sole connector 105, and sixth sole connector 106. Loop connectors are used for the sole connectors 101-106 in one embodiment, as the loop material is the soft side of hook-and-loop fasteners, and as the sole connectors are on the sole where a user places their foot and provide for user comfort.

Sole connectors 101-106 can be any number of connectors that enable a foot fastener to be connected to the sole, including between 3 and 12, between 5 and 8, between 6 and 8, more than 3, more than 6, and more than 8. As disclosed in the embodiment according to FIG. 1, six connectors are shown. The sole connectors placed in this embodiment structurally support the foot fastener connection to the sole. In the embodiment of FIG. 1, sole connectors 101 and 106 are on the fifth toe (pinky toe) side (left side); sole connectors 103, 104 and 105 are on the first toe (big toe) side (right side), and sole connector 102 is capable of allowing the foot fastener 311 (shown in FIG. 3A) to act as a toe thong 840 (shown in FIG. 8) between two adjacent toes, such as the first toe (big toe) and the second toe. Sole connectors 102, 105, and 106 are used when the shoe comprising sole 107 is in a flip-flop mode. Sole connectors 101, 103, and 104 are used when the shoe comprising sole 107 is in a sandal mode.

In embodiments, a distance between sole connectors 102 and 105 can be equal to a distance between sole connectors 102 and 106. In embodiments, a distance between sole connectors 101 and 103 can be equal to a distance between sole connectors 101 and 104. In embodiments, a distance between sole connectors 102 and 105, a distance between sole connectors 102 and 106, a distance between sole connectors 101 and 103, and a distance between sole connectors 101 and 104 can all be equal. In embodiments, a first distance between sole connectors 102 and 105 equals a first distance between sole connectors 102 and 106, and a second distance between sole connectors 101 and 103 equals a second distance between sole connectors 101 and 104, but the first distance does not equal the second distance.

Figure 2:
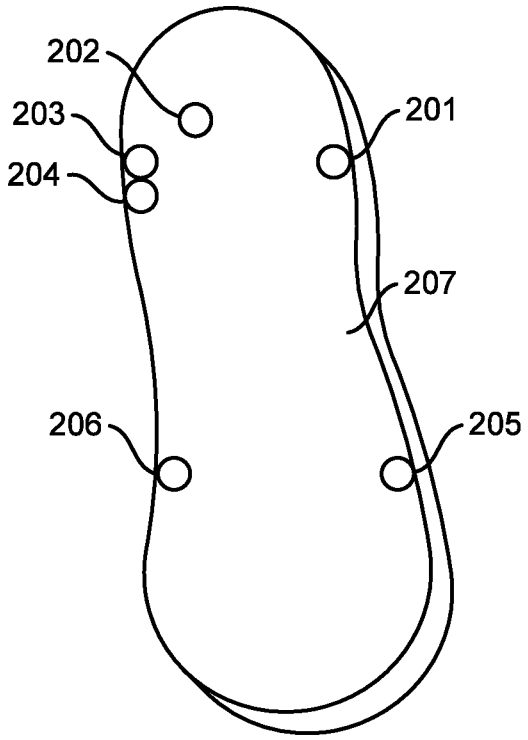
FIG. 2 is top view of a right sole disclosing another embodiment according to the present disclosure.

FIG. 2 shows a right shoe of an embodiment disclosing sole 207. Sole 207 contains a plurality of sole connection devices, such as circular Velcro® connectors. For example, sole 207 can have a plurality of Velcro® loop connectors including first sole connector 201, second sole connector 202, third sole connector 203, fourth sole connector 204, fifth sole connector 205, and sixth sole connector 206. Sole connectors 201-206 can be any number of sole connectors that enable a foot fastener to be connected to the sole, including between 3 and 12, between 5 and 8, between 6 and 8, more than 3, more than 6, and more than 8. As disclosed in the embodiment of FIG. 2, six connectors are shown (although less sole connectors could be used if some of the sole connectors were used for both the flip-flop and sandal mode). The sole connectors placed in this embodiment structurally support the foot fastener connection to the sole.

In the embodiment of FIG. 2, sole connectors 201 and 206 are on the fifth toe (pinky toe) side (right side); sole connectors 203, 204 and 205 are on the first toe (big toe) side (left side), and sole connector 202 is capable of allowing the foot fastener 321 (shown in FIG. 3B) to act as a toe thong 840 (shown in FIG. 8) between two adjacent toes, such as the first toe (big toe) and the second toe. Sole connectors 202, 205, and 206 are used when the shoe comprising sole 207 is in a flip-flop mode. Sole connectors 201, 203, and 204 are used when the shoe comprising sole 207 is in a sandal mode.

In embodiments, a distance between sole connectors 202 and 205 can be equal to a distance between sole connectors 202 and 206. In embodiments, a distance between sole connectors 201 and 203 can be equal to a distance between sole connectors 201 and 204. In embodiments, a distance between sole connectors 202 and 205, a distance between sole connectors 202 and 206, a distance between sole connectors 201 and 203, and a distance between sole connectors 201 and 204 can all be equal. In embodiments, a first distance between sole connectors 202 and 205 equals a first distance between sole connectors 202 and 206, and a second distance between sole connectors 201 and 203 equals a second distance between sole connectors 201 and 204, but the first distance does not equal the second distance.

Shoes will generally be a pair of shoes that comprise a left shoe and a right shoe, with left and right shoes each having a sole and the sole connectors as described herein.

Figure 3C:
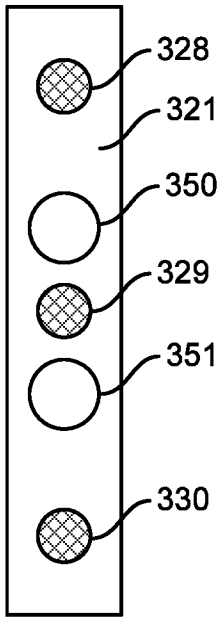
FIG. 3C is top view of a foot fastener disclosing another embodiment according to the present disclosure.
Figure 3B:
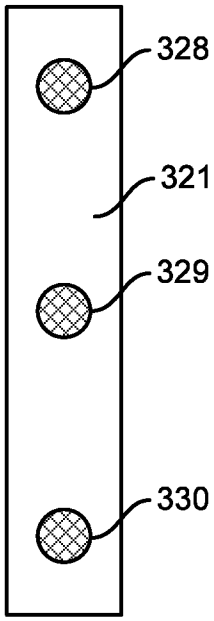
FIG. 3B is top view of a foot fastener disclosing another embodiment according to the present disclosure.
Figure 3A:
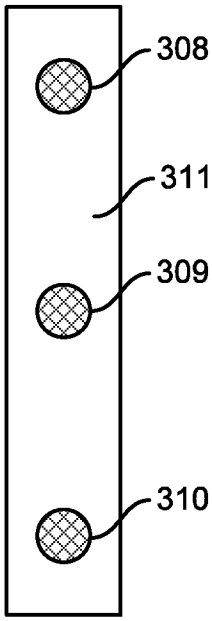
FIG. 3A is top view of afoot fastener disclosing another embodiment according to the present disclosure.

FIG. 3A is top view of a foot fastener. For a left shoe, foot fastener 311 can include a plurality of Velcro® hook connectors including first foot fastener connector 308, second foot fastener connector 309, and third foot fastener connector 310. The Velcro® hook connector side is, in one embodiment, on the foot fastener 311 as it is less in contact with a user's foot than the sole of the shoe. Foot fastener connectors 308-310 can be any number of foot fastener connectors that enable the (left) foot fastener 311 to be connected to the (left) sole 107, including 3 or more, between 3 and 4, between 3 and 5, between 4 and 6, more than 4, more than 5, and more than 6. As disclosed in the embodiment of FIG. 3A, 3 foot fastener connectors are shown. The ends of foot fastener 311 can be flat, rounded, curved, or the like. In embodiments, the foot fastener connectors 308 and 309 can be spaced equally as foot fastener connectors 309 and 310.

FIG. 3B is top view of a foot fastener. For a right shoe, foot fastener 321 can include a plurality of Velcro® hook connectors including first foot fastener connector 328, second foot fastener connector 329, and third foot fastener connector 330. Foot fastener connectors 328-330 can be any number of foot fastener connectors that enable the (right) foot fastener 321 to be connected to the (right) sole 207, including 3 or more, between 3 and 4, between 3 and 5, between 4 and 6, more than 4, more than 5, and more than 6. As disclosed in the embodiment of FIG. 3B, 3 foot fastener connectors are shown. The ends of foot fastener 321 can be flat, rounded, curved, or the like. In embodiments, the foot fastener connectors 328 and 329 can be spaced equally as foot fastener connectors 329 and 330.

FIG. 3C is top view of a foot fastener disclosing another embodiment according to the present disclosure. Shaping areas 350 and 351 are portions that have been incorporated into foot fastener 321 that help shape the foot fastener 321 into a toe thong. In one embodiment, shaping areas 350 and 351 are areas where portions of foot fastener 321 material have been removed. In another embodiment, shaping areas 350 and 351 can be a thinner material or different material that helps shape that portion of foot fastener 321 into the toe thong. The shaping areas 350 and 351 are shown to the same size and shape, however, it is not required that they be so. While the shaping areas, foot fastener connectors, and sole connectors are depicted in the aforementioned figures as being circular, embodiments according to the present disclosure can be of any geometry.

When it is desired to switch the shoe between a flip-flop mode and a sandal mode, foot fasteners 311, 321 can be removed from the respective soles 107, 207 and then placed into the desired configuration. For example, when desired to use the shoe in the flip-flop mode, (left) foot fastener 311 is connected to (left) sole 107 using a foot fastener connector 308 to sole connector 106; foot fastener connector 309 is connected to sole connector 102; and foot fastener connector 310 is connected to sole connector 105. The (right) foot fastener 321 is connected to (right) sole 207 using foot fastener connector 328 to sole connector 206; foot fastener connector 329 is connected to sole connector 202; and foot fastener connector 330 is connected to sole connector 205.

Figure 4:
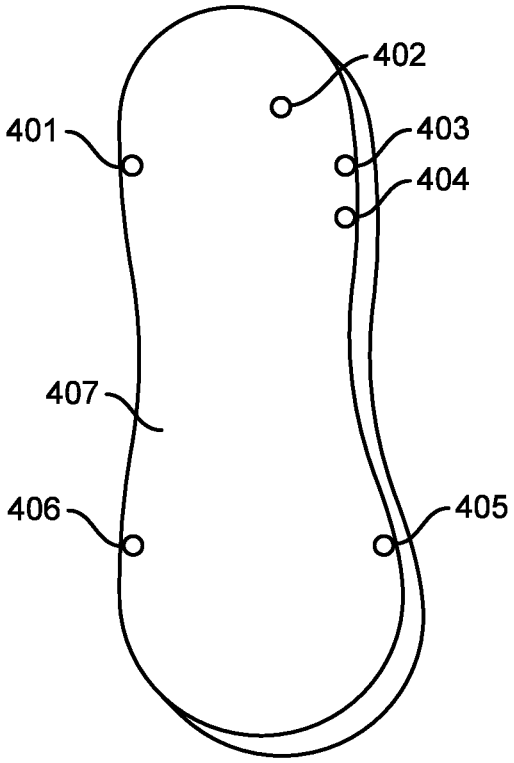
FIG. 4 is top view disclosing another embodiment according to the present disclosure.

FIG. 4 shows an embodiment using magnets instead of Velcro®. The magnets that maybe used may be neodymium iron boron (NdFeB), samarium cobalt (SmCo), alnico, and/or ceramic/ferrite magnets. For example, a strontium ferrite ($SrO_6Fe_2O_3$) magnet may be used. As shown in FIG. 4, a (left) shoe sole 407 comprising sole connectors 401, 402, 403, 404, 405, and 406 may be magnets. In one embodiment, these magnets are each north poles of the magnets. However, in another embodiment they may be each be south poles of the magnets. However, the polarity of the magnets for the sole connector is to be the opposite polarity of the magnets on the foot fasteners. These sole connectors also correspond to the locations shown in FIG. 1.

Figure 5:
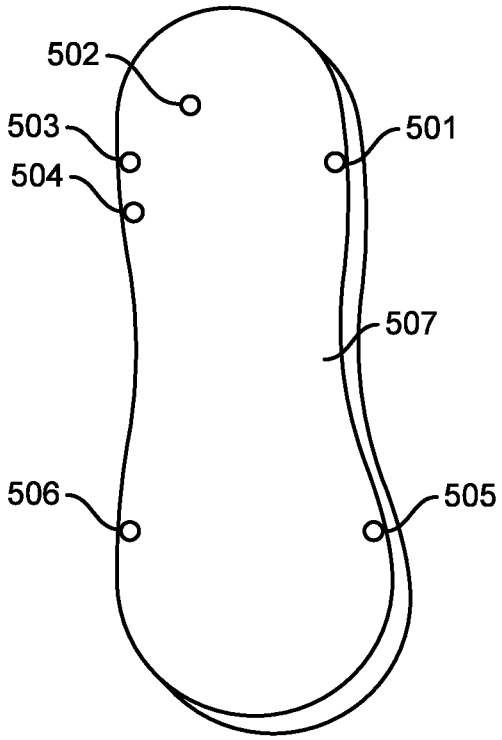
FIG. 5 is a top view disclosing another embodiment according to the present disclosure.

FIG. 5 also shows an embodiment using magnets instead of Velcro®. The magnets that maybe used may be neodymium iron boron (NdFeB), samarium cobalt (SmCo), alnico, and ceramic/ferrite magnets. For example, a strontium ferrite ($SrO_6Fe_2O_3$) magnet may be used. As shown in FIG. 5, a (right) shoe sole 507 comprising sole connectors 501, 502, 503, 504, 505, and 506 may be magnets. In one embodiment, these magnets are each north poles of the magnets. However, in another embodiment they may be each be south poles of the magnets. However, the polarity of the magnets for the sole connector is to be the opposite polarity of the magnets on the foot fasteners. These sole connectors also correspond to the locations shown in FIG. 2.

Figure 6:
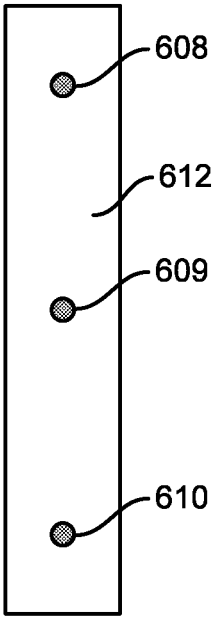
FIG. 6 is atop view of a foot fastener disclosing another embodiment according to the present disclosure.

FIG. 6 shows a foot fastener 612 using magnets. If north poles of the magnets are used on the sole, then foot fastener 612 uses south poles of the magnets. If south poles of the magnets are used on the sole, then foot fastener 612 uses the north poles of the magnets. In one preferred embodiment, the soles 402, 502 uses north poles of the magnets and the foot fastener 612 uses south poles of the magnets. Foot fastener 612 uses foot fastener connects 608, 609, and 610. These foot fasteners also correspond to the locations as shown in FIG. 3. Foot fastener 612 may be used in conjunction with the (left) shoe sole 407 or the (right) shoe sole 507 as long as the complementary poles of the magnets are properly selected.

Foot fasteners can be constructed from an elastic material or inelastic material. In embodiments where the sole connectors are positioned such that the first distance between sole connectors 202 and 205 equals the first distance between sole connectors 202 and 206, and the second distance between sole connectors 201 and 203 equals the second distance between sole connectors 201 and 204, but the first distance does not equal the second distance, foot fasteners constructed from an elastic material are preferred. In this manner, the foot fastener can stretch to accommodate the differences in length between when a shoe is in the sandal mode and when the shoe is in the flip-flop mode. In embodiments where the sole connectors are positioned such that the distance between sole connectors 202 and 205, the distance between sole connectors 202 and 206, the distance between sole connectors 201 and 203, and the distance between sole connectors 201 and 204 are all equal, foot fasteners constructed from an inelastic material can be used. In this manner, the foot fastener does not need to stretch to accommodate the same lengths between when a shoe is in the sandal mode and when the shoe is in the flip-flop mode.

In general, foot fasteners can be constructed of elastic bands, textile material, plastic, nylon, polyester, leather, woven material, non-woven material, and the like. While the aforementioned distances are described in terms of the right shoe and right sole, the foot fasteners embodiments apply similarly to the left shoe and the left sole. While the aforementioned sole connectors are described with regards to FIG. 2, the sole connectors positioning on the sole applies similarly to FIGS. 1, 4, 5, 8, and 9.

Figure 7A:
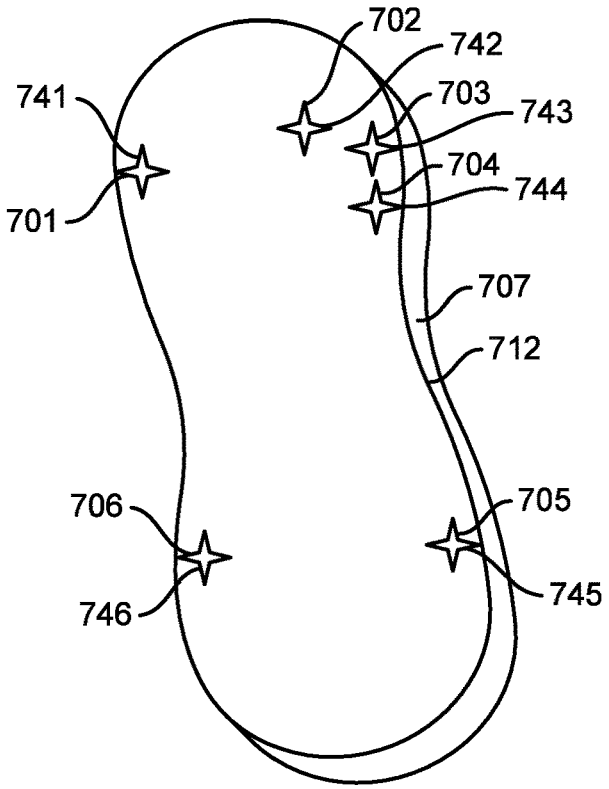
FIG. 7A is top view of a cover disclosing another embodiment according to the present disclosure.

FIG. 7A shows a cover 712. Cover 712 covers sole 707 such as to hide the sole connectors 701, 702, 703, 704, 705, and 706. Cover 712 can be configured to be either a left cover for the left sole or right cover for the right sole. When it is desired to connect a foot fastener to sole 707, slits 741, 742, 743, 744, 745, and 746 in the cover 712 allows access to sole connectors 701, 702, 703, 705, 705, and 706. The slits can be a hole or cut that allows access to the sole connectors, but also covers the sole connectors when not in use. Thus, when desired to connect foot fasteners to sole connectors, the slits are opened and provide access to the sole connectors. Slits 741, 742, 743, 744, 745, and 746 can be selected to be the same number as there are sole connectors. Slits 741, 742, 743, 744, 745, and 746 can be in the shape of an "X", a single cut, a star, two crossing cuts, a circle, a triangle, a hexagon, a square, an oval, and the like.

Figure 7B:
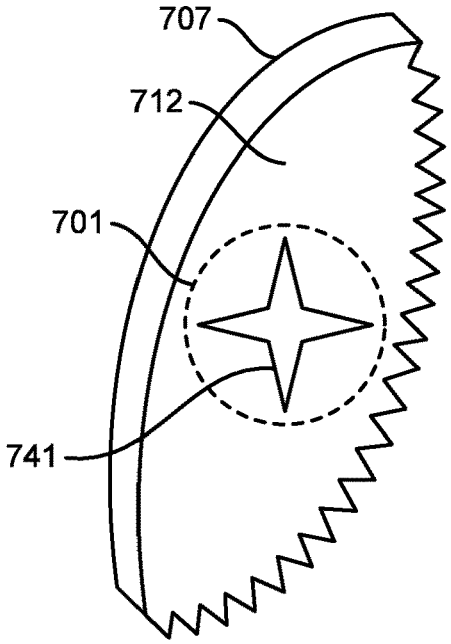
FIG. 7B is a partial view of a cover according to an embodiment according to the present disclosure.

FIG. 7B shows a partial view of the cover 712. For example, slit 741 in cover 712 allows access to sole connector 701, while keeping a user's foot from rubbing against the sole connector 701. This would apply similarly for slits 702-706, which cover sole connectors 742-746.

Figure 8:
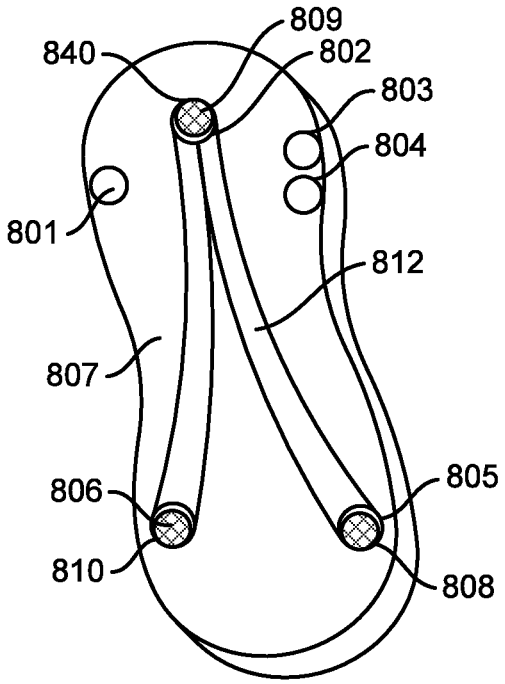
FIG. 8 is a top view disclosing another embodiment according to the present disclosure in flip-flop mode.

FIG. 8 is an embodiment showing shoe 807 in a flip-flop mode. Foot fastener 812, with foot fastener connectors 808, 809, and 810, are connected to sole connectors 805, 802, and 806, respectively. When in the flip-flop mode, a toe thong 840 is formed from foot fastener 812, which is capable of being between two adjacent toes, preferably the big toe and the second toe. To help facilitate toe thong 840, foot fastener 812 can include shaping areas 350 and 351 (as shown in FIG. 3C) to shape foot fastener 812 to better fit between the two adjacent toes and provide a wearer with more comfort. Sole connectors 801, 803, and 804 are not used when in the flip-flop mode. While a left shoe is shown, the right shoe would be the same, but reversed.

Figure 9:
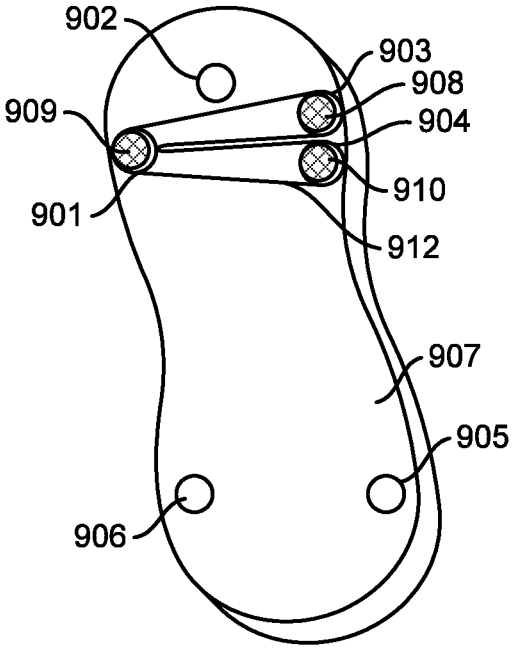
FIG. 9 is a top view disclosing another embodiment according to the present disclosure in sandal mode.

FIG. 9 is an embodiment showing shoe 907 in a sandal mode. Foot fastener 912, with foot fastener connectors 908, 909, and 910, are connected to sole connectors 903, 901, and 904, respectively. Sole connectors 902, 905, and 906 are not used when in a sandal mode. While a right shoe is shown in FIG. 9, the left shoe would be the same, but reversed. While in a sandal mode, foot fastener 912 does not form a toe thong.

For example, when desired to use the shoe in sandal mode, left foot fastener 311 is connected to sole 107 using foot fastener connector 308 to sole connector 101; foot fastener connector 309 to sole connector 103; and foot fastener connector 310 to sole connector 104. Right foot fastener 321 is connected to sole 207 using foot fastener connector 328 to sole connector 201; foot fastener connector 329 to sole connector 203; and foot fastener connector 330 to sole connector 204.

When desiring to switch to sandal mode, the foot fasteners 311, 321 can be removed and then connected to soles 107, 207 as shown in FIG. 9. When desiring to switch to flip-flop mode, the foot fasteners 311, 321 can be removed and then connected to soles 107, 207 as shown in FIG. 8.

Figure 10A:
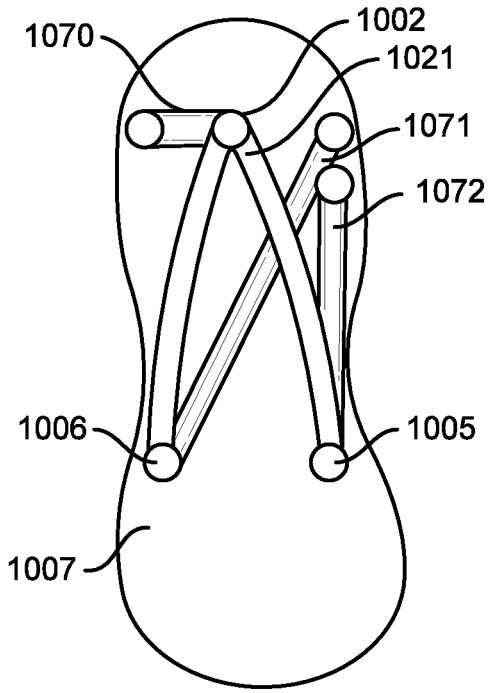
FIG. 10A is atop view disclosing another embodiment according to the present disclosure using a slide feature.

FIG. 10A shows an embodiment according to the present disclosure using a slide feature showing a shoe 1007 in a flip-flop mode. Here, the slide connectors are in the position shown for the flip-flop mode. Toe slide path 1070 is where foot fastener 1021, which comprises a slide connector 1002, slides across the sole of shoe 1007. Once the slide connector is in a desired place, it can lock in such that it will not move without excessive force. Slide connector 1002 can be made of any suitable material such as plastic, rubber, metal, or the like. Slide connector 1005 slides along a right slide path 1072. Slide connector 1006 slides along a diagonal slide path 1071. By using the slide connectors, the shoe can be converted between a sandal mode and a flip-flip mode without having to remove foot fastener 1021. When desired to switch modes, the slide connectors can be moved to the alternative position, locking in place at their respective positions. For example, when switching from a flip-flop mode to a sandal mode, the slide connectors move from positions show in FIG. 10A to FIG. 10B.

Figure 10B:
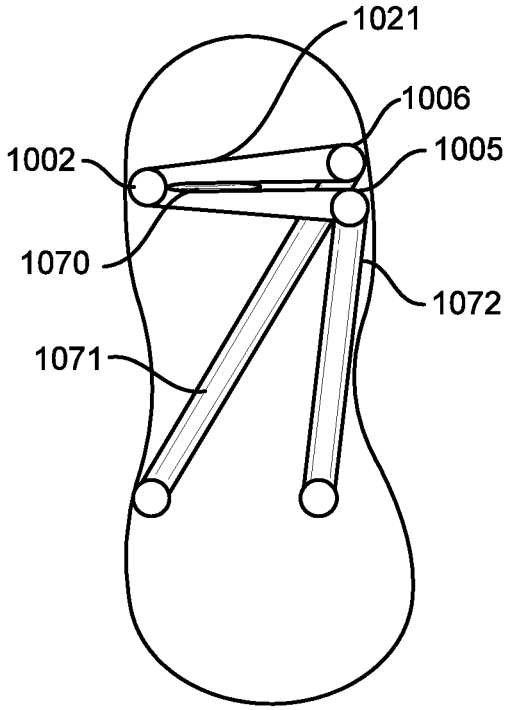
FIG. 10B is a top view disclosing another embodiment according to the present disclosure using a slide feature.

FIG. 10B shows an embodiment according to the present disclosure using the slide feature showing the shoe 1007 in a sandal mode. Here, the slide connectors are in the position shown for the sandal mode. Toe slide path 1070 is where foot fastener 1021, which comprises a slide connector 1002, slides across the sole of shoe 1007. Slide connector 1005 slides along right slide path 1072. Slide connector 1006 slide along diagonal slide path 1071.

Foot fastener 1021 can also be adjustable in length, using for example a buckle, Velcro®, cam buckle, D-rings, or the like. Foot fastener 1021 could also be made of an elastic material that allows it to stretch to different sizes. This can allow for different feet sizes to fit within the shoe. In one embodiment, foot fastener 1021 when used in flip-flop mode is half the size of foot fastener 1021 when used in sandal mode, and thus when used in flip-flop mode, the foot fastener 1021 is double backed.

Although a few variations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. Similarly, elements located on the front, back, side, top, or bottom of an embodiment or implementation are to be understood as relatively positioned, unless otherwise specified. Other embodiments can be within the scope of the claims.

This application is intended to cover any variations, uses or adaptations of the invention following, in general, the principles of the invention, and including such departures from the present disclosure as come within known and customary practice within the art to which the invention pertains. The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. A method comprising:

providing a shoe comprising a sole, wherein at least three sole connectors are on the sole;

providing a first slide path extending laterally across the sole, the first slide path having a first flip-flop position and a first sandal position that are situated at opposing ends of the first slide path, the first slide path configured to retain a first sole connector of the at least three sole connectors, and the first sole connector configured to be selectively locked into one of the first flip-flop position or the first sandal position;

providing a second slide path extending vertically across the sole along a side of the sole, the second slide path having a second flip-flop position and a second sandal position that are situated at opposing ends of the second slide path, the second slide path configured to retain a second sole connector of the at least three sole connectors, and the second sole connector configured to be selectively locked into one of the second flip-flop position or the second sandal position;

providing a third slide path extending diagonally across the sole, the third slide path having a third flip-flop position and a third sandal position that are situated at opposing ends of the third slide path, the third slide path configured to retain a third sole connector of the at least three sole connectors, and the third sole connector configured to be selectively locked into one of the third flip-flop position or the third sandal position;

connecting at least three foot fastener connectors to the first sole connector, the second sole connector, and the third sole connector of the at least three sole connectors, wherein said connecting causes the at least three foot fastener connectors to form a toe thong in a flip-flop configuration in response to the first sole connector being selectively locked into the first flip-flop position, the second sole connector being selectively locked into the second flip-flop position, and the third sole connector being selectively locked into the third flip-flop position; and transitioning the shoe from the flip-flop configuration to a sandal configuration by sliding the first sole connector along the first slide path from the first flip-flop position to the first sandal position, sliding the second sole connector along the second slide path from the second flip-flop position to the second sandal position, and sliding the third sole connector along the third slide path from the third flip-flop position to the third sandal position, wherein the at least three foot fastener connectors are interconnected with a foot fastener.

2. The method according to claim 1, wherein said at least three foot fastener connectors comprise magnets that are configured to selectively couple to the at least three sole connectors.

3. The method according to claim 2, wherein the magnets include at least one of neodymium iron boron (NdFeB), samarium cobalt (SmCo), alnico, or strontium ferrite (SrO6Fe2O3).

4. The method according to claim 2, wherein the at least three sole connectors are magnetic, and wherein the at least three sole connectors and the at least three foot fastener connectors are configured to selectively couple via magnetic attraction.

5. The method according to claim 4, wherein the at least three foot fastener connectors' magnets have a first polarity and the at least three sole connectors have magnets with a second polarity, wherein the first polarity and the second polarity are different from each other and are magnetically attracted to each other.

6. The method according to claim 4, wherein the at least three foot fastener connectors' magnets have a north pole polarity and the at least three sole connectors have magnets with a south pole polarity.

7. The method according to claim 4, wherein the at least three foot fastener connectors' magnets have a south pole polarity and the at least three sole connectors have magnets with a north pole polarity.

8. The method according to claim 1, wherein said at least three foot fastener connectors comprise hook-and-loop fasteners.

9. The method according to claim 1, wherein the foot fastener has a length, and the method further comprises:

adjusting the length of the foot fastener in response to transitioning the shoe from the flip-flop configuration to the sandal configuration.

10. The method according to claim 1, wherein the sandal configuration does not have the toe thong and the flip-flop configuration has the toe thong, the toe thong being formed by the foot fastener.

11. The method according to claim 10, wherein the toe thong formed by the foot fastener is configured to be positioned between two adjacent toes of a user's foot for keeping the shoe on the user's foot.

12. The method according to claim 11, wherein the toe thong may be selectively adjusted to be positioned between different combinations of two adjacent toes by sliding the first sole connector along the first slide path while the shoe is in the flip-flop configuration.

* * * * *